United States Patent [19]

Reischl

[11] 3,935,725

[45] Feb. 3, 1976

[54] AUTOMOBILE FRAME AND BODY REPAIRING APPARATUS

[76] Inventor: Norbert M. Reischl, 13759 Mar Vista St., Whittier, Calif. 90607

[22] Filed: June 13, 1974

[21] Appl. No.: 478,981

[52] U.S. Cl. ..... 72/451; 72/705

[51] Int. Cl.[2] ..... B21D 1/12

[58] Field of Search ..... 72/705, 451; 74/520; 254/9 R, 93 R

[56] References Cited

UNITED STATES PATENTS

| | | | |
|---|---|---|---|
| 3,131,748 | 5/1964 | Junkins | 72/705 X |
| 3,141,493 | 7/1964 | Textor, Sr. | 72/705 X |
| 3,556,482 | 6/1971 | Whitney | 72/705 X |
| 3,589,680 | 6/1971 | Kuhn | 72/705 X |
| 3,614,151 | 10/1971 | Shadle | 74/520 X |
| 3,817,081 | 6/1974 | Morski et al. | 72/705 X |

FOREIGN PATENTS OR APPLICATIONS

| | | | |
|---|---|---|---|
| 329,131 | 1/1971 | Sweden | 72/705 |
| 1,528,865 | 5/1968 | France | 72/705 |

*Primary Examiner*—C. W. Lanham
*Assistant Examiner*—D. M. Gurley

[57] ABSTRACT

A horizontal support frame having an upstanding lever pivoted to the frame adjacent one end thereof with the toggle comprising a pair of arms having adjacent ends pivoted together, the opposite end of one of the arms being pivotly connected adjacent the end of the frame opposite the upstanding lever. The opposite end of the other arm is pivotly connected to the upstanding lever intermediate the ends thereof. A hydraulic actuator for the upstanding lever comprises a cylinder having one end closed and the opposite end open, the closed end being pivotly connected to the pivotly connected ends of the toggle arms. A piston is reciprocally mounted in the cylinder and has a piston rod extending outwardly of the open end of the cylinder, the free end of the piston rod being pivotly connected to the frame on the same pivot pin pivotly connecting the lower end of the lever to the frame. On the side of the upstanding lever, opposite the toggle mechanism, a bar is welded or otherwise suitably secured to the lever and provided with a series of longitudinally spaced holes for reception of a pin for pivotly connecting a yoke to said bar at various positions along said bar. The side of the lever opposite the bar, is provided with a socket for reception of an end of a holding bar. At the lever end of the frame is a part for reception of a second holding bar and at the toggle end of the frame, there is means for anchoring the apparatus to a floor or platform or the like.

9 Claims, 8 Drawing Figures

AUTOMOBILE FRAME AND BODY REPAIRING APPARATUS

SUMMARY OF THE INVENTION

The invention comprises a T-shaped horizontal support frame, the longitudinally extending stem part being longer than the cross piece at one end which is laterally normal relative to the longitude of the stem.

An upstanding lever is pivoted to the frame adjacent the cross piece end. The stem part of the frame has a pair of plates which are spaced apart and the pivoted end of the upstanding lever is oppositely disposed between said plates.

There is a toggle which comprises two pairs of arms, the arms of each pair being parallel and spaced apart. One pair of arms have ends that are pivoted to the upstanding lever while the other pair of arms are pivoted to the stem part of the frame adjacent the end opposite the cross piece. The opposite ends of the pairs of arms are pivoted together and there is a hydraulic actuator having a cylinder closed at one end and open at the other. The closed end of the cylinder has a pivotal connection with the ends of the arms that are pivoted together. Within the cylinder is a piston having a piston rod which extends outwardly of the open end of the cylinder and is pivoted to the pivot pin pivotly connecting the lower end of the upstanding lever with the stem part of the frame.

At the rear end of the stem part of the frame opposite the cross piece, there is means for anchoring the frame to a fixed support such as, for example, the floor upon which the apparatus is supported.

Along the floor edge of the upstanding lever is a bar welded or otherwise suitably secured to the lever, there being a series of longitudinally spaced holes in the bar for reception of a pin for pivotly connecting a yoke or the like to said bar at various positions longitudinally along said bar. At the opposite edge of the bar, there is a socket for reception of an end of a holding bar. Means is provided at the rear or free end of the stem of the frame for connecting a chain which in turn is connected to the adjacent part of the vehicle being repaired. At the same part of the stem of the frame there is also means for abutment of a holding bar.

With this apparatus, various push and/or pull forces may be applied to various parts of the vehicle being repaired to effectively straighten out parts of the vehicle that have been damaged.

Rollers or wheels are provided at the forward side of the cross piece and adjacent the ends thereof whereby the apparatus may be readily moved to various positions.

OBJECTS AND ADVANTAGES OF THE INVENTION

It is an object of the invention to provide apparatus of this character that is highly effective in applying forces to vehicle parts that require straightening and/or repairing.

It is another object of the inventioon to provide apparatus of this character whereby push and/or pull forces are applied to a vehicle body for repair of same.

Still another object of the invention is to provide apparatus of this character whereby there is a substantial power gain as applied to the vehicle.

A further object of the invention is to provide apparatus of this character that is relatively small in size but highly effective in operation.

A still further object of the invention is to provide apparatus of this character that is relatively light in weight.

The characteristics and advantages of the invention are further sufficiently referred to in connection with the following detailed description of the accompanying drawings, which represent one embodiment. After considering this example, skilled persons will understand that many variations may be made without departing from the principles disclosed and I contemplate the employment of any structures, arrangements or modes of operation that are properly within the scope of the appended claims.

BRIEF DESCRIPTION OF THE DRAWINGS

Referring to the drawings, which are for illustrative purposes only.

DESCRIPTION OF THE PREFERRED EMBODIMENTS

Figures 1, 2, 3, 4, 5:
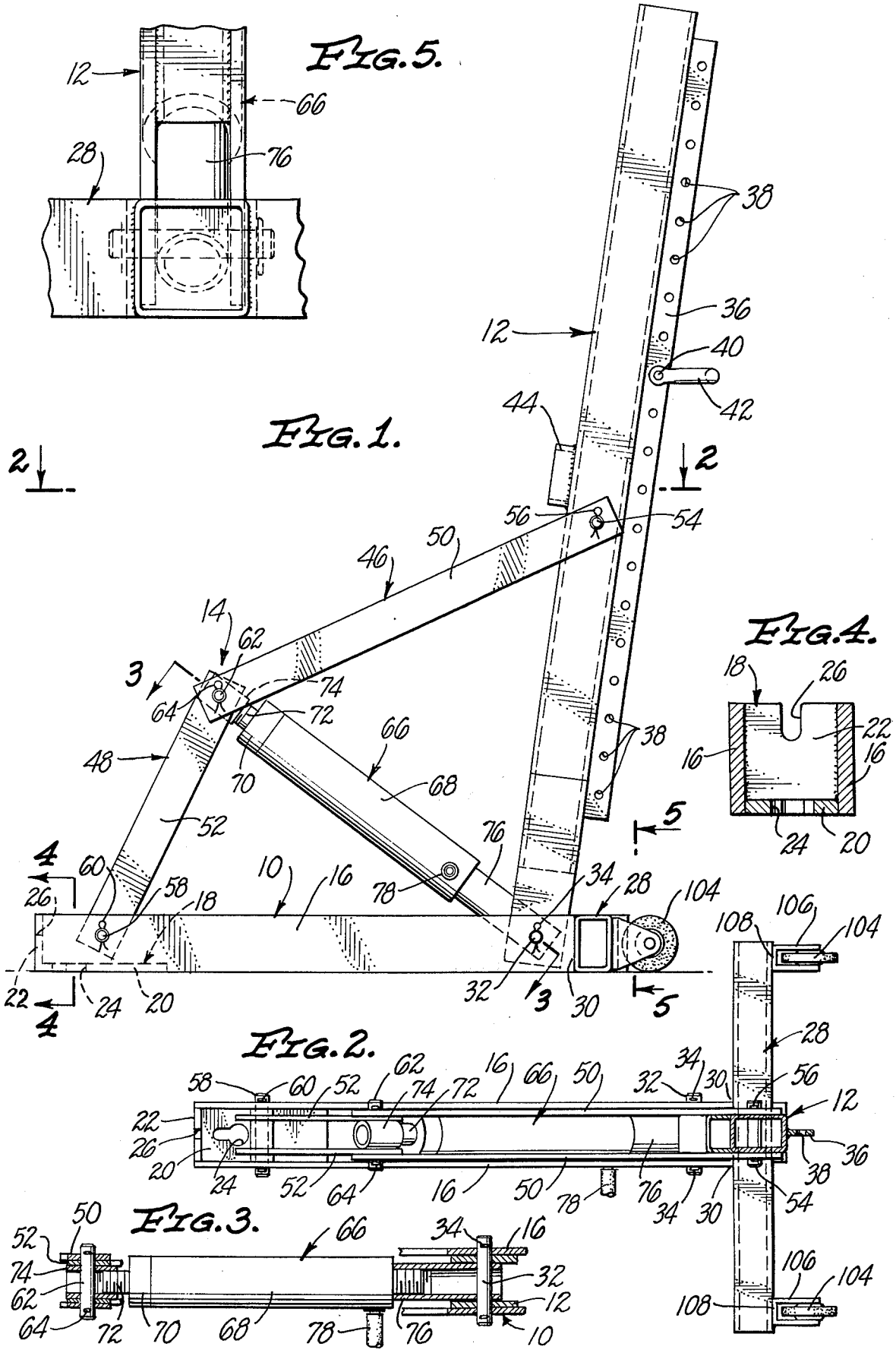
FIG. 1 is a side elevational view of apparatus embodying the present invention.
FIG. 2 is a sectional view taken on line 2—2 of FIG. 1.
FIG. 3 is a sectional view taken on line 3—3 of FIG. 1.
FIG. 4 is a sectional view taken on line 4—4 of FIG. 1.
FIG. 5 is a sectional view taken on line 5—5 of FIG. 1.

Referring more particularly to FIGS. 1 – 5, there is shown apparatus embodying the present invention, there being a T-shaped horizontal support frame, indicated at 10, an upstanding power lever indicated generally at 12, and actuator means indicated generally at 14.

Frame 10 comprises a pair of parallel plates 16 which are spaced apart. At what will be termed the rear or free end of the frame, there is a bracket indicated generally at 18 between said plates, bracket 18 having a horizontal part 20 and an upstanding part 22 at the free end of the plates. Bracket 18 is welded to the parallel plates 16 and the horizontal part 20 is provided with a key-hole slot 24 while the vertical or upstanding part 22 has a notch 26 therein.

At what is termed the forward or front end of the frame has the cross piece indicated generally at 28, which has a welded connection 30 with the front ends of the plates 16, cross piece 28 being tubular and of generally rectangular cross section as best shown in FIG. 1.

Upstanding power lever 12 is also tubular and generally rectangular in shape. The lower end of lever 12 is received between the plates 16 adjacent the cross piece 28 and is pivotly mounted on a pivot pin 32 which extends through aligned openings in the respective plates 16 and secured in position by cotter pins 34. Along the forward edge of the power lever 12 is a bar 36 which is welded or otherwise suitably secured to lever 12 and provided with a series of longitudinally spaced openings 38 for reception of a pin 40 for attaching a yoke 42 to the bar 36. With this arrangement, the yoke may be variously attached to the bar and hence to the power lever at various positions longitudinally of said bar and lever. At the opposite or rear edge of power lever 12, is a socket 44 which is welded to said lever and is adapted to receive one end of a pressure bar as will be described hereinafter.

The actuator means 14 comprises a toggle joint comprising two sets of arms 46 and 48, each set of arms has a pair of parallel, latterally spaced bars 50 and 52 respectively. The ends of bars 50 adjacent the lever 12, are pivoted to the respective sides of said lever by means of a pivot pin 54 secured in position by a cotter pin 56. The ends of bars 52 adjacent the rear or free end of the stem of the frame are pivoted to the respective side plates thereof by means of pivot pins 58 secured in position by cotter pins 60. At their opposite ends, the bars 50 and 52 are pivoted together by means of a pivot pin 62 which is held in position by means of cotter pins 64 thus forming what is termed a knee.

Power actuating means for actuating the knee comprises a hydraulic jack, indicated generally at 66, having a cylinder 68 one end of which has a cap 70 which has an opening through which operably extends a piston rod 72 of a piston operably disposed in said cylinder 68, said piston rod having a threaded outer end portion threadably disposed in a tapped sleeve having aligned openings therein, said sleeves being disposed on said pin. At its opposite end, cylinder 68 has an extension which has its free end pivoted on pin 32 which also serves as a pivot for the upstanding lever 12. Pressure fluid is delivered to the interior of the cylinder through a connection 78, said pressure fluid being provided by any suitable well-known means.

Figure 6:
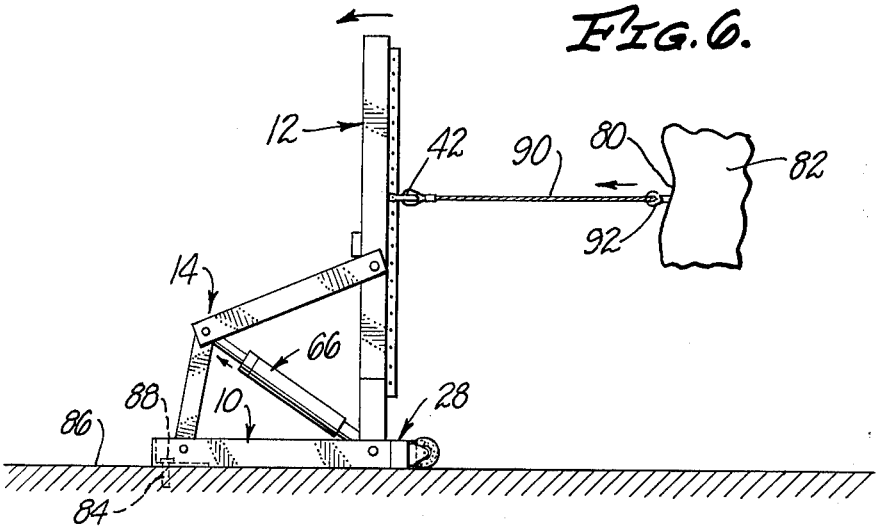
FIGS. 6, 7 and 8 are side elevational views showing various ways for using the apparatus.

Referring to FIG. 6, the apparatus is shown as being used to pull out a body part 80 of an automobile body 82. In order to anchor the apparatus, there is a pin 84 embedded in the support 86 upon which the apparatus is disposed. Pin 84 extends through the key hole opening 24 in the horizontal part 20 of the bracket 18 and has a head 88 which prevents the rear part of the apparatus from raising up when the lever 12 is actuated in a clock-wise direction. In order to effect a pulling action on the portion 80 of the body 82, the automobile must, of course, be held stationary by any suitable well-known means and lever 12 is connected to the part 82 by means of a cable 90 having one end connected to the yoke 42, the opposite end of the cable is provided with a device 92 of any well-known character for securing the cable to the part 80 so that it can be pulled outwardly when pressure fluid is applied to the hydraulic jack 66. This pressure fluid forces the knee of the toggle joint diagonally rearwardly thus actuating lever 12 in the counter clock-wise direction.

Figure 7:
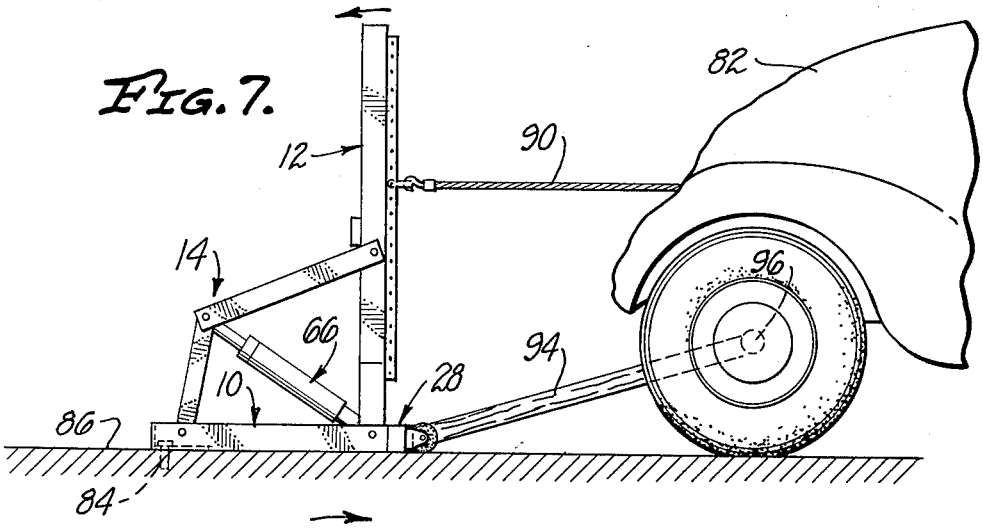

Referring to FIG. 7, the apparatus is shown positioned as in FIG. 6 with the cable 90 attached to the automobile body 82.

However, in FIG. 7, there is a holding bar 94 having one end abutting against the cross piece 28 and the opposite end abutting against a part of the automobile, this part being shown as the front axle 96. Holding bar 94 is one means for holding the automobile in a fixed position relative to the present apparatus, it being understood that other means may be used as pointed out above in connection with the description of FIG. 6.

Figure 8:
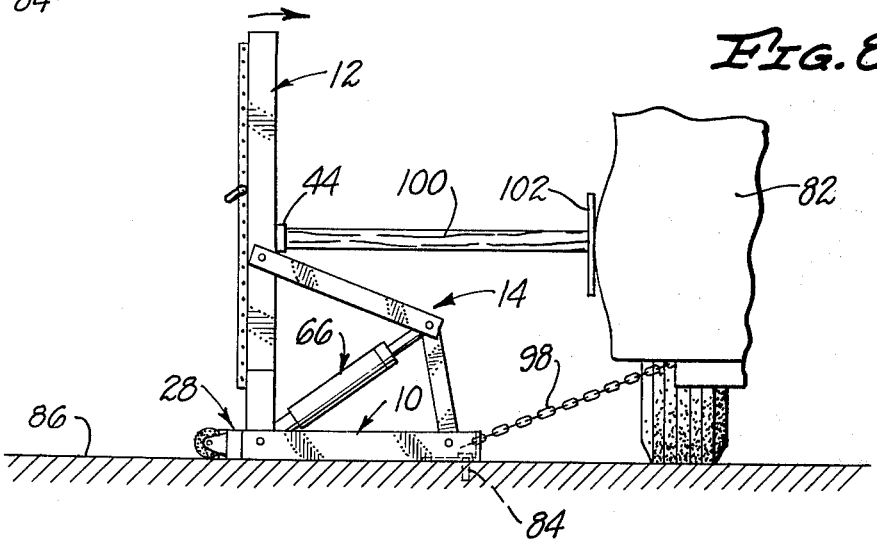

Referring to FIG. 8, the present apparatus is in the opposite position as compared with the positioning shown in FIGS. 6 and 7. Here, the apparatus is also anchored on pin 84. There is also a chain 98 anchored to the bracket 18 by having a link disposed in the notch

26. The other end of the chain is secured to the automobile by any suitable well-known means. Thus, the automobile is held against movement to the right as shown in FIG. 8. A pressure bar 100 is provided and has one end disposed in the socket 44, the opposite end is provided with a plate 102 and application of pressure fluid to the hydraulic jack 66 causes lever 12 to move in the clockwise direction thus applying pressure through the pressure bar 100 to the part of the automobile body that is to be forced to the right as shown in FIG. 8.

At each end of the cross piece 28 is a wheel or roller 104. Each roller is disposed between a generally U-shaped part 106 with the closed end 108 secured to the front face of the cross piece. The wheels 104 have their lower edges in substantially the same plane as the underside of the cross piece or even slightly above same. When it is desired to move the apparatus apart, the rear end of the stem 16 is released from attachment to the support or the like, then by raising the rear part of the stem, the wheels 104 will be brought into contact with the support or other surface so that the apparatus may be rolled from one place to another.

The invention and its attendant advantages will be understood from the foregoing description and it will be apparent that various changes may be made in the form, construction and arrangement of the parts without departing from the spirit or scope thereof or sacrificing its material advantages, the arrangement hereinbefore described being merely by way of example and I do not wish to be restricted to the specific form shown or uses mentioned except as defined in the accompanying claims.

I claim:

1. An automobile frame and body repairing apparatus, comprising:

a horizontal T-shaped frame including a longitudinally extending stem and a cross piece at one end of said stem;

an upstanding power lever pivoted at its lower end adjacent a forward end of said frame, said lever having a bar secured to the forward side thereof, the bar having a plurality of longitudinally spaced openings therein;

means at the end of the stem opposite the cross piece for securing the frame against longitudinal movement;

means for actuating said power level, said means comprising a toggle joint having members with ends joined to form a knee, the opposite ends of said members being pivotally connected to the frame stem adjacent the rear end and to the upstanding lever intermediate its ends respectively; and and power means connected to said frame at the lower end of said power lever and to the knee of the toggle joint for actuating said toggle joint to cause pivotal movement of the upstanding power lever.

2. The invention defined by claim 1, including a rearwardly opening socket connected to the upstanding power lever for reception of one end of a pressure bar.

3. The invention defined by claim 2, including means for connecting the frame of the apparatus to a part of an automobile to be repaired for preventing the apparatus and the automobile from moving apart, said pressure bar being adapted to exert pressure upon a part of the automobile to be repaired.

4. The invention defined by claim 2, including means for holding the apparatus and the automobile apart and cable means connecting a part of the automobile to the bar of the upstanding lever whereby operable movement of said lever exerts a pulling force on the automobile.

5. The invention defined by claim 2, including a holding bar between the front end of the frame and a part of an automobile to be repaired to prevent the apparatus and the automobile from being drawn toward each other; and means connecting a part of the automobile to the bar of the upstanding lever whereby operable movement of said lever exerts a pulling force on the automobile.

6. The invention defined by claim 4, wherein last mentioned means includes yoke means for various attachment thereof to the bar and longitudinally thereof of the upstanding lever.

7. The invention defined by claim 2, wherein the stem of the frame comprises a pair of laterally spaced plates secured in parallel relationship to each other; the pressure bar being pivoted at its lower end between said plates; the members of the toggle joint each comprising a pair of laterally spaced parallel bars; and the power means comprising a hydraulic jack.

8. The invention defined by claim 1, including wheels secured to the cross piece of the frame adjacent the ends of said cross piece, said wheels being positioned for non-support of the frame when the latter is in its horizontal operating positon.

9. The invention defined by claim 1, wherein said members include at least one bar.

* * * * *